United States Patent [19]

Tominari et al.

[11] 4,422,123

[45] Dec. 20, 1983

[54] CIRCUIT FOR DRIVING SOLENOID AT HIGH SPEED WITH CHOKE COIL

[75] Inventors: Noboru Tominari; Shuichi Kamiyama, both of Tokyo, Japan

[73] Assignee: Mikuni Kogyo Co., Ltd., Tokyo, Japan

[21] Appl. No.: 343,705

[22] Filed: Jan. 28, 1982

[51] Int. Cl.[3] ..... H01H 47/22

[52] U.S. Cl. ..... 361/152; 361/159

[58] Field of Search ..... 361/152, 159, 4, 204

[56] References Cited

U.S. PATENT DOCUMENTS 3,746,927 7/1973 Marino ..... 361/4

*Primary Examiner*—Reinhard J. Eisenzopf

*Attorney, Agent, or Firm*—Andrus, Sceales, Starke & Sawall

[57] ABSTRACT

A circuit for driving a solenoid at a high speed with a choke coil, which has a pair of switching circuits alternatively turned ON and OFF by a transistor, a solenoid coil connected to one of the switching circuits, a resistor connected to the other of the switching circuits, and a choke coil connected in series with the switching circuit and in parallel with a power source. Thus, this circuit can abruptly raise an electric current flowing through the solenoid coil by utilizing the constant current characteristics of the choke coil and the current switching characteristics of the transistor.

5 Claims, 9 Drawing Figures

CIRCUIT FOR DRIVING SOLENOID AT HIGH SPEED WITH CHOKE COIL

BACKGROUND OF THE INVENTION

This invention relates to a circuit for driving a solenoid at a high speed using a choke coil and, more particularly, to a high speed solenoid driving circuit with a choke coil adapted to abruptly rising an electric current flowing through the coil of the solenoid by means of the constant current characteristic of the choke coil and of the current switching characteristic of a transistor.

A method of converting an electric signal into a mechanical movement via a solenoid is widely used heretofore due to the inexpensiveness and the simple mechanical structure. There are generally used in the utilization of the electromagnetically attracting force of the solenoid a method of mechanically operating by a switch, and a method of controlling an electric current flowing through the coil of the solenoid in accordance with the voltage of a signal source by utilizing the switching characteristic of a transistor, since the latter method can operate the solenoid without a manual switch, it is used for the case of operating a number of operations within a predetermined time. Inasmuch as this method however employs a solenoid coil having an inductance, an electric current flowing through the coil of the solenoid cannot abruptly change, and this method accordingly has such drawbacks that the rising characteristic of the current becomes worse particularly when an electromagnetic force is produced at the solenoid.

FIG. 1 shows a conventional solenoid driving circuit of a resistance driving type having a resistor $R_1$. When a DC current (12 volts) is supplied from a battery B through a switch SW such as, for example, a transistor or the like to this driving circuit, even if a signal S rises as designated by a broken line in a current flow curve in FIG. 2, an electric current flowing through a solenoid coil SC will rise as designated by a curve i of solid line in a predetermined primary delay characteristic to approach a predetermined content value. That is, since the time constant $t_1$ representing the rising speed of the current at this time is signified by L/R, the value of the resistor $R_1$ should be increased so as to shorten the time constant $t_1$, but if the resistance of the resistor $R_1$ is thus increased, the value of the current becomes small and the magnetic force of the solenoid coil accordingly becomes small. Therefore, the movement of an actuator attracted by the solenoid becomes worse. Consequently, the rising speed of the current is thus limited. If the value of the inductance of the L is decreased so as to shorten the time constant $t_1$, the value of the current also becomes small and the magnetic force of the solenoid coil accordingly becomes small. Resultantly, the movement of the actuator attracted by the solenoid also becomes worse. In order to heretofore improve such a delay in raising the current flowing through the solenoid, a voltage applied to the solenoid coil at the time of rising the current flowing through the solenoid coil is increased in a trend. Particularly when a battery voltage is utilized for a vehicle or the like, a power source for raising the voltage should be additionally provided, and results in the increase in the cost and the complexity of the circuit and further in the power loss in the circuit as its drawback.

SUMMARY OF THE INVENTION

A primary object of this invention is to provide a circuit for driving a solenoid at a high speed using a choke coil which eliminates the drawbacks and disadvantages of the conventional solenoid driving circuit for abruptly raising an electric current flowing through the solenoid coil by utilizing the constant current characteristics of a choke coil and the current switching characteristic of a transistor.

Another object of this invention is to provide a circuit for driving a solenoid at a high speed using a choke coil which does not raise its voltage but retains low voltage to improve the operating characteristics of the solenoid by connecting a solenoid coil to one of a pair of switching circuits alternately turned ON or OFF by a transistor and connecting a resistor to the other of the switching circuits or a solenoid coil to both the switching circuits and connecting both the circuits in parallel with the power line having the choke coil.

Still another object of this invention is to provide a circuit for driving a solenoid at a high speed using a choke coil which can drive the solenoid at high speed by improving the operating characteristics of the solenoid.

BRIEF DESCRIPTION OF THE DRAWINGS

These and other objects, features and advantages of the invention will be seen by reference to the description, taken in connection with the accompanying drawings, in which.

DESCRIPTION OF THE PREFERRED EMBODIMENTS

Figure 3:
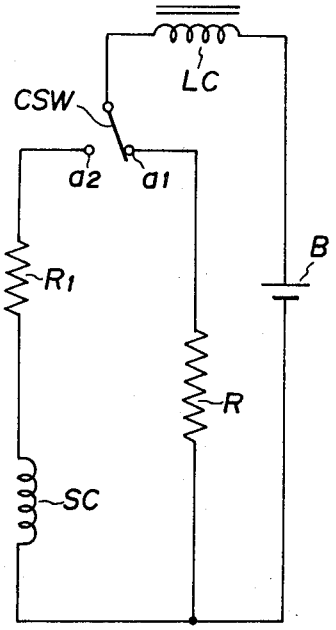
FIG. 3 is a circuit diagram showing the fundamental circuit of a solenoid high speed driving circuit using a choke coil according to this invention.
Figure 2:
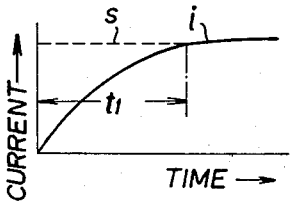
FIG. 2 is a graphic representating showing the current vs. time characteristic of the conventional solenoid driving circuit shown in FIG. 1.

Reference is now made to the drawings, and particularly to FIG. 3 which shows one preferred embodiment of the solenoid high speed driving circuit of the invention as a fundamental circuit. The solenoid high speed driving circuit essentially comprises a battery B, a choke coil Lc, a changeover switch CSW of a transistor, a resistor R, an additional resistor $R_1$, and a solenoid coil SC. Substantially equal current will flow in both circuits $a_1$ and $a_2$ switched by the switch CSW.

Figure 4:
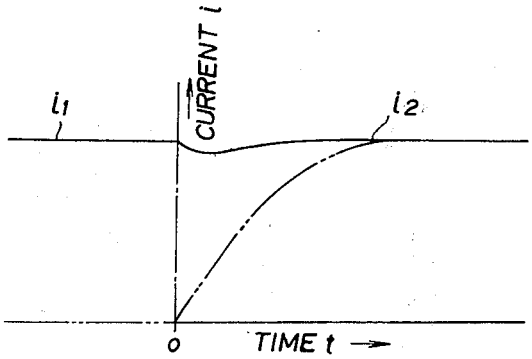
FIG. 4 is a graphical representation showing the current vs. time characteristic of the solenoid high speed driving circuit of this invention shown in FIG. 3.

In this circuit, when an electric current flowing now in the circuit $a_1$ is switched to the circuit $a_2$ by the switch CSW, it will change in very small amount as designated by a curve $i_2$ shown at the right side of a switching point 0 in the current characteristic graph in FIG. 4. More particularly, the current flowing at the left side of the switching point 0 is an electric current $i_1$ before it is switched. Since the inductance of the choke coil Lc has a property of disturbing the change of the current, the value of the current immediately after switching will become substantially equal to the current $i_1$, and will slightly decrease later, but retain almost constant value.

However, according to the conventional driving circuit, for comparison, the current when switched will smoothly rise from the switching point 0 as designated by a one-dotted broken line in FIG. 4. Since the current according to the driving circuit of this invention will start rapidly from a predetermined value, the attracting force necessary for an actuator can be produced within a short time as compared with the conventional driving circuit.

Figure 5:
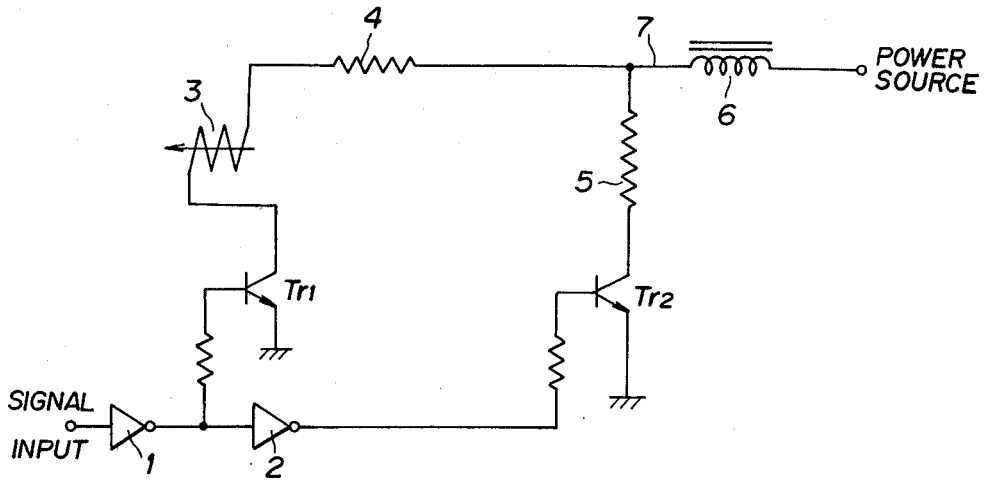
FIG. 5 is a circuit diagram showing another preferred embodiment of the solenoid high speed driving circuit of this invention.

FIG. 5 shows another preferred embodiment of the solenoid high speed driving circuit of this invention. This driving circuit comprises a pair of transistors Tr1 and Tr2, inverters 1 and 2 inserted in the signal input of switching circuits for alternately turning ON and OFF, a solenoid coil 3 and an additional resistor 4 connected to one of the switching circuits, a resistor 5 connected in the other of the switching circuits, and a choke coil 6 connected between both the switching circuits and a power source in series at a power line 7 in parallel with the power source. Substantially equal current will flow in both the circuits.

In this circuit thus consturcted according to this invention, when an input signal of the inverter 1 is raised to highlevel, the inverter 1 will produce a low level output. Thus, the low level output is inputted to the transistor Tr1, which sequentially turns OFF and consequently flows no current through the solenoid coil 3. Simultaneously, the inverter 2 receives the low level output from the inverter 1 and produces a high level output. Thus, the high level output is inputted to the transistor Tr2, which sequentially turns ON and consequently flows an electric current through the choke coil 6, the resistor 5 and the transistor Tr2.

When the input signal is then lowered to low level in this state, the inputs and the outputs of the inverters 1 and 2 are inverted, and the operating states of the transistors Tr1 and Tr2 are also inverted. Thus, the transistor Tr1 is turned ON, while the transistor Tr2 is simultaneously turned OFF. Accordingly, the current flowing through the choke coil 6, the resistor 5 and the transistor Tr2 is altered to flow through the additional resistor 4, the solenoid coil 3 and the transistor Tr1, but the choke coil 6 continues to flow the constant current therethrough due to its property. Therefore, the current flowing through the solenoid coil 3 can rapidly rise as described above.

When the solenoid is driven actually by the conventional driving circuit and the driving circuit according to this invention, the rising time in the driving circuit of this invention can be shortend by 30% as compared with the conventional driving circuit.

Figure 6:
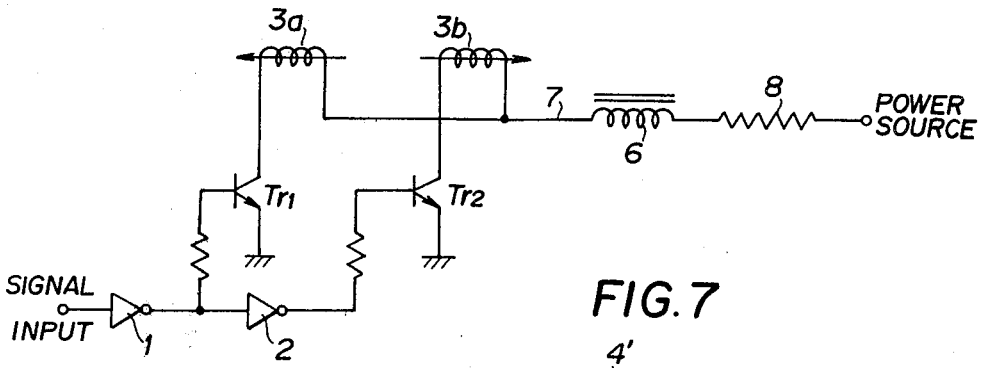
FIG. 6 is a circuit diagram showing the push-pull operation of the circuit shown in FIG. 5.

FIG. 6 shows still another preferred embodiment of the solenoid high speed driving circuit of this invention. This driving circuit comprises solenoid coils inserted in both a pair of switching circuits and operated in push-pull operation. That is, a pushing solenoid coil 3*a* is inserted into one of the switching circuits, and a pulling solenoid coil 3*b* is inserted into the other of the switching circuit instead of the resistor 5 show in FIG. 5, and a current limiting resistor 8 is connected to the choke coil 6.

This circuit is very simple capable of effectively operating the two solenoid coils according to the principle of this invention.

Figure 1:
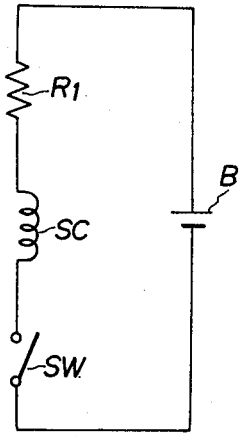
FIG. 1 is a circuit diagram showing a conventional solenoid driving circuit.
Figure 7:
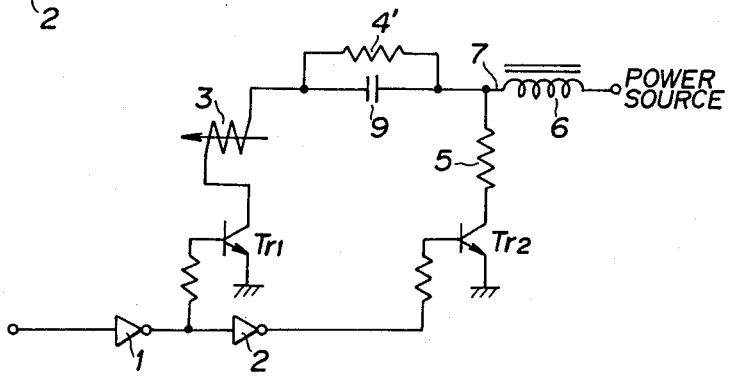
FIG. 7 is a circuit diagram showing still another preferred embodiment of the solenoid high speed drivng circuit of this invention utilizing a capacitor.

FIG. 7 shows still another preferred embodiment of the solenoid high speed driving circuit of this invention. This driving circuit comprises a capacitor 9 connected in parallel with the additional resistor 4 shown in FIG. 5 for reducing the ordinary current flowing through the solenoid coil, and a resistor 4' connected in parallel with the capacitor 9 and having higher resistance than the resistor 4. The capacitor 9 exhibits almost no resistance against the rapid voltage change, and accordingly has zero impedance. Accordingly, even if the value of the resistance of the resistor 4' is high, it becomes zero resistance. Since the impedance of the parallel circuit of the capacitor 9 and the resistor 4' approaches the value of the resistor 4' as the time is elapsed, the magnitude of the current when the current value becomes constant becomes smaller than that of the conventional circuit shown in FIG. 1.

Figure 8:
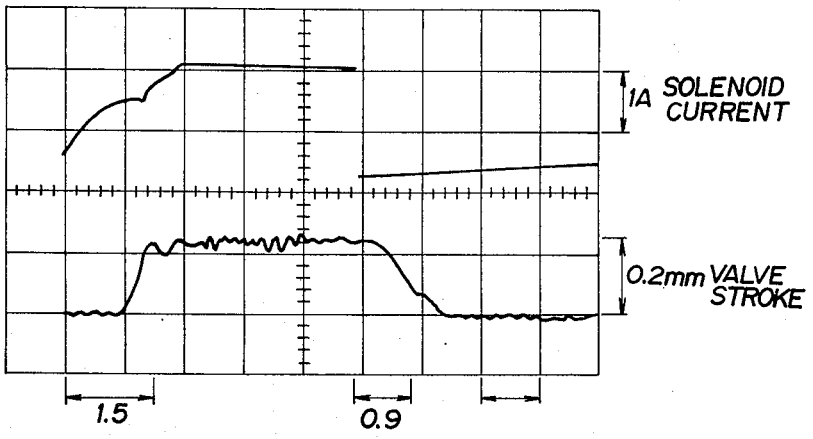
FIGS. 8A and 8B show graphical representations showing the waveforms of the conventional circuit and the circuit according to this invention on oscillograph.
Figure 8B:
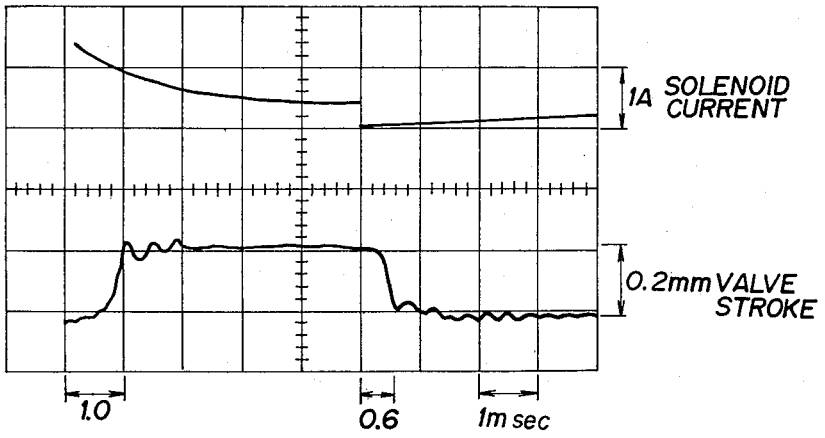

FIGS. 8A and 8B show the waveforms on an oscillograph obtained by measuring the changes of the current and the bulb stroke when the solenoid valve is driven by the conventional driving circuit and the driving circuit according to this invention shown in FIG. 7, wherein FIG. 8A shown the waveform according to the conventional driving circuit and FIG. 8B shown the wave form according to the driving circuit of this invention.

As evident from these waveforms, when the valve moves at a stroke of 0.1 mm in FIG. 8A, the solenoid current requires approx. 1.5 msec. in opening direction and approx. 0.9 msec. in closing direction. When the valve moves at the same stroke in FIG. 8B, the solenoid current requires approx. 1 msec. in opening direction and approx. 0.6 msec in closing direction. Thus, the solenoid current in FIG. 8B is improved by approx. 30% as compared with those in FIG. 8A in responding speed. Further, for the rise of the current waveform, the current in FIG. 8B abruptly rises as compared with the current in FIG. 8A. In addition, by adding the capacitor, the ordinary current value exhibits 1.6 ampere in FIG. 8A, while it exhibits 0.4 ampere in FIG. 8B.

When the capacitor is adopted in this manner to reduce the ordinary current value in the circuit, the holding force of the actuator can be reduced. Accordingly, the return of the actuator after the current of the solenoid coil is interrupted can be quickened, and yet even by the capacitor, it does not affect the rise of the current but adds only the advantage to the driving circuit.

Since the solenoid high speed driving circuit of this invention thus comprises as described above a pair of switching circuits turned ON or OFF alternately by the transistor, a solenoid coil connected to one of the switching circuits, a resistor connected to the other of the circuits or the solenoid coil connected to both the circuits, and a choke coil connected to both the circuits in parallel with the power line to abruptly rise the current flowing through the solenoid coil by the constant current characteristics of the transistor, it can improve the operating characteristics of the solenoid without raising the voltage applied thereto as the conventional driving circuit but by retaining the low voltage thereto and can abruptly rise the current flowing through the solenoid to rapidly operate the solenoid valve.

What is claimed is:

1. A circuit for driving a solenoid at a high speed with a choke coil comprising:

a pair of switching circuit means alternately turned ON and OFF by a switching element, a first solenoid coil connected to one of said switching circuit means, a second solenoid coil defining a resistance element connected to the other of said switching circuit means, and said two circuit means being connected in parallel with a powerline having said choke coil.

2. The circuit according to claim 1, wherein said two solenoid coils are connected in push-pull operation.

3. The circuit according to any of claims 1 or 2 wherein said switching element has a plurality of transistors.

4. The circuit according to any of claims 1 or 2 wherein said first solenoid coil is a solenoid valve.

5. The circuit according to any of claims 1 or 2 wherein said solenoid coil is the coil of a pulse motor.

* * * * *

UNITED STATES PATENT AND TRADEMARK OFFICE

CERTIFICATE OF CORRECTION

PATENT NO. : 4,422,123

DATED : December 20, 1983

INVENTOR(S) : NOBORU TOMINARI ET AL

It is certified that error appears in the above-identified patent and that said Letters Patent are hereby corrected as shown below:

Col. 5, Line 11, CLAIM 5, After "said" insert ---first---

Signed and Sealed this

*Seventh* Day of *August 1984*

[SEAL]

*Attest:*

GERALD J. MOSSINGHOFF

*Attesting Officer*

*Commissioner of Patents and Trademarks*